US006431946B1

(12) United States Patent
Fildan et al.

(10) Patent No.: US 6,431,946 B1
(45) Date of Patent: Aug. 13, 2002

(54) UNDERWIRE ASSEMBLY FOR BRASSIERES AND THE LIKE

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 75 days.

(21) Appl. No.: 09/816,786

(22) Filed: Mar. 23, 2001

(51) Int. Cl.[7] ..... A41C 3/00
(52) U.S. Cl. ..... 450/41; 450/51
(58) Field of Search ..... 450/41, 45, 46, 450/47, 48, 49, 51, 52, 53; 2/67, 255–260.1, 264

(56) References Cited

U.S. PATENT DOCUMENTS 3,030,633 A * 4/1962 Chalfin ..... 450/41
3,531,807 A * 10/1970 Devito et al. ..... 450/41
3,747,606 A * 7/1973 Tareau ..... 450/48
4,133,316 A * 1/1979 Schwartz ..... 450/51
4,153,062 A * 5/1979 Delet ..... 450/51
4,201,220 A * 5/1980 Rowell ..... 450/52
230,462 A 7/1980 Bortree
4,222,387 A 9/1980 Tetu
4,235,240 A * 11/1980 Cousins ..... 450/52
4,269,191 A 5/1981 Evans
5,938,500 A 8/1999 Hampton
6,186,862 B1 * 2/2001 Fildan ..... 450/41

* cited by examiner

*Primary Examiner*—Gloria M. Hale
(74) *Attorney, Agent, or Firm*—Herbert Dubno

(57) ABSTRACT

A compound wire assembly is provided by sandwiching a plastic wire between layers of fabric and securing the wire in place by ultrasonically welding the fabric layers together through holes in the wire. The assembly forms an underwire structure for the cup of a brassiere.

26 Claims, 17 Drawing Sheets

UNDERWIRE ASSEMBLY FOR BRASSIERES AND THE LIKE

FIELD OF THE INVENTION

Our present invention relates to an underwire assembly for brassieres and the like and, more particularly, to the combination of an underwire and fabric structure connected to the underwire for improving the support provided in an underwire brassiere over other garments utilizing an underwire.

BACKGROUND OF THE INVENTION

Underwires have been provided heretofore in brassieres to increase the support along the lower portions of the cup. Such underwires in the past have generally comprised metallic or in plastic members which have been configured to flex in the plane of the underwire and which have been received in tubular formations provided in the brassiere fabric so as to provide support for the cup and to impart a certain optimum shape to the cup in the plane of the wire. Metal wires coated with plastic have also been provided for this purpose and it is also known, in securing the underwire in its channel or tubular pocket, to form an underwire with a stitching flange at an end of the underwire or at one or more locations along its length to enable the underwire to be stitched through to retain it in place in its channel.

Underwires of this type are widely effective but frequently have characteristics which render them unsatisfactory. For example, the underwire may not be sufficiently rigid in its plane and sufficiently flexible transversely to its plane. The formation of a tubular pocket in the fabric into which the underwire must be inserted may be complex and costly.

Frequently the region in which the underwire is provided is insufficiently padded so that there is a danger that the underwire may be felt by the wearer. Problems with underwires include insufficient attachment of the underwire to the fabric so that the underwire may move in its pocket and pierce through the fabric to cause injury to the wearer or cause damage to the brassiere or other garment during washing.

OBJECTS OF THE INVENTION

It is therefore the principal object of the present invention to provide an improved underwire assembly whereby the aforedescribed problems are obviated.

Another object of this invention is to provide an underwire assembly which has sufficient rigidity in its plane and flexibility transverse to its plane and yet constrains the underwire against free movement with respect to the garment and at the same time prevents the underwire from pressing through the fabric against the wearer.

It is also an object of this invention to improve the versatility of an underwire mounting and thereby reduce the cost and the number of operations needed in the manufacture of a brassiere or like garment having an underwire.

Yet another object of this invention is to provide an underwire assembly which, for a given underwire, can have controlled stiffness or flexibility in one or more directions and which nevertheless can provide different degrees of support at different locations along the underwire.

SUMMARY OF THE INVENTION

These objects are attained, in accordance with the invention, in an underwire assembly which is a composite of a wire and a fabric structure associated with the wire at least in part by being ultrasonically bonded through holes in the wire and thereby being fixed to the wire so that the fabric forms a relatively soft element of the composite structure while the wire forms a relatively rigid or hard element of that structure.

According to a feature of the invention, the fabric comprises at least two layers ultrasonically bonded together through holes in the wire and without prior formation of a channel or tubular pocket in the fabric. The fabric and the wire together are fixed in the garment and form a composite assembly which replaces the wire alone.

Once the assembly is incorporated in the garment, the wire cannot move because the fabric is welded through the holes in the wire fabric-to-fabric.

The composite structure of the fabric and the wire increases the support which can be provided by a wire and hence a thinner or less massive wire structures are used. The fabric layer on opposite sides of the wire may be of the same material or of different materials and the fabric can even be elastic in whole or in art.

An outer or inner end of the fabric can be used to make a seam or to connect the structure to the fabric of the cup.

The fabric on one side can be a brushed tricot which is flexible or inflexible, soft or hard, and preferably is turned toward the body and helps to contribute to the comfort of the garment in the portion thereof against the body. One of the other fabric layers may be padded or a pad can be introduced between the fabric layer and held in place by a weld seam extending at least partly around the pad.

Preferably the wire is a plastic wire provided with spaced-apart holes but the holes may be circular, oval or even rectangular with an elongated shape preferred.

The wire itself may be formed with relatively thick ribs along its inner and outer edges and a thinner web which can be provided with the holes according to the invention.

The structure is designed so that it is asymmetrical with reference to the cup in the sense that the composite wire assembly extends upwardly to a lesser extent along the midline of the brassiere and the inner side of the respective cups and to a greater extent along the exterior side of the cup. In the system of the invention, the welds are effected fabric-to-fabric rather than between fabric and a stiff plastic which ensures a softer structure and one which is less brittle than systems in which the weld is effected to a stiff plastic bar.

The system completely eliminates the need for separately making a channel and inserting an underwire therein and hence the operations involved in folding a woven bias tape and stitching the seam to produce the channel can be completely eliminated.

The fabric used as part of this composite can be filled with any type of padding, for example a gel, and the selection of various types of fabric for the inner and outer surfaces can provide different fields of optical effects as may be desired.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
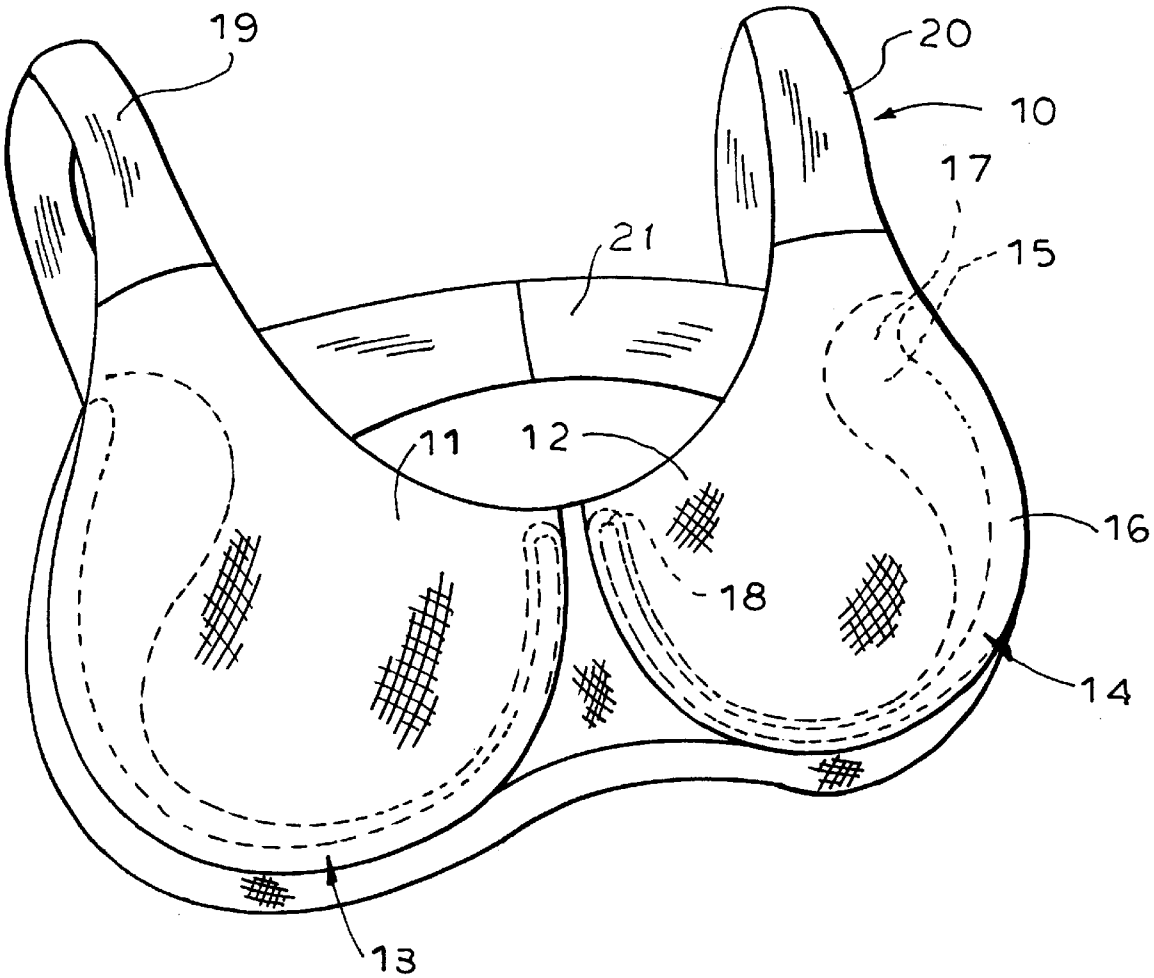
FIG. 1 is an elevational view of a brassiere showing the use of a composite underwire assembly according to the invention.
Figure 2:
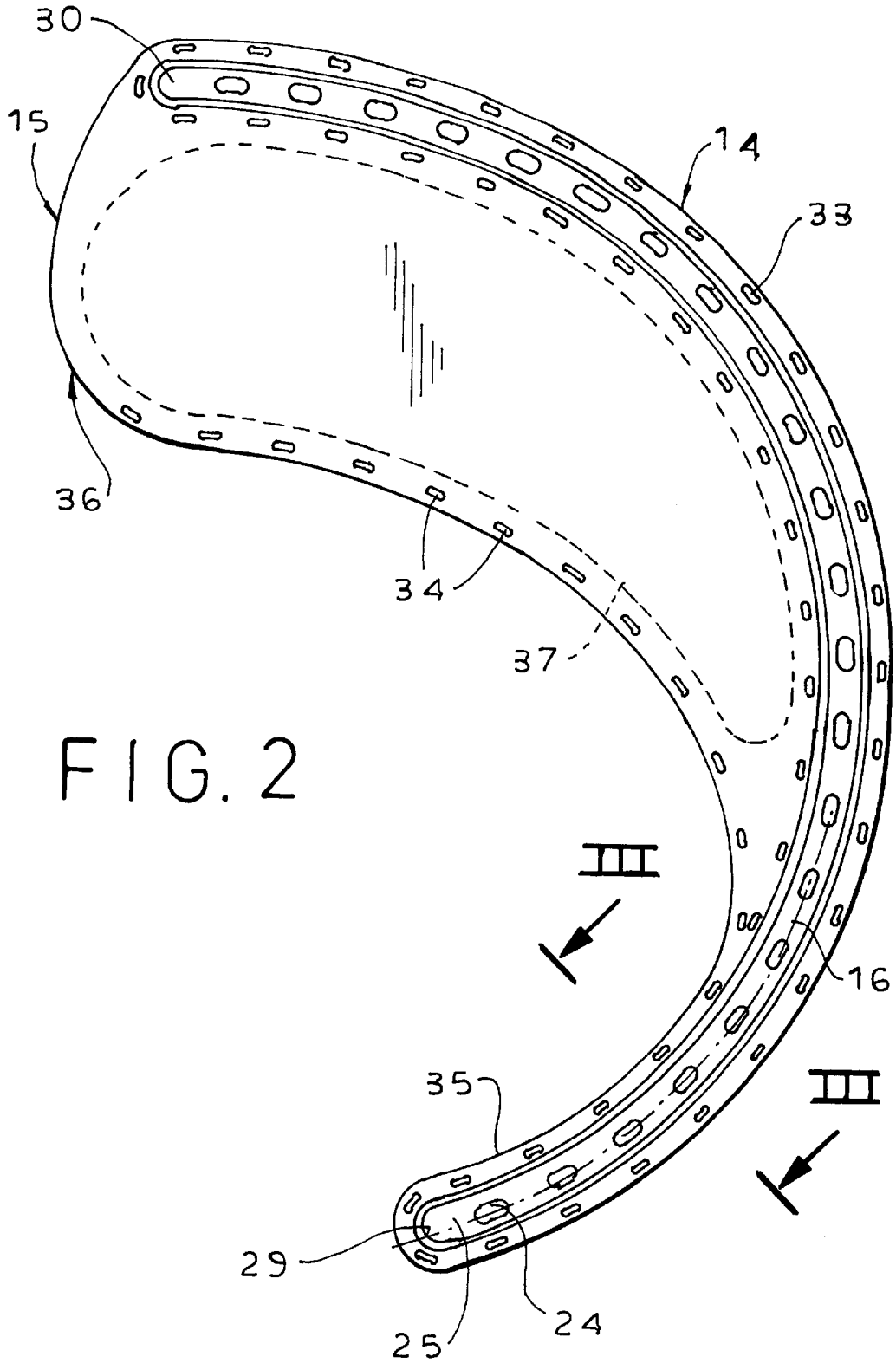
FIG. 2 is an elevational view, partly in diagrammatic form, showing a compound wire assembly according to the invention.
Figure 3:
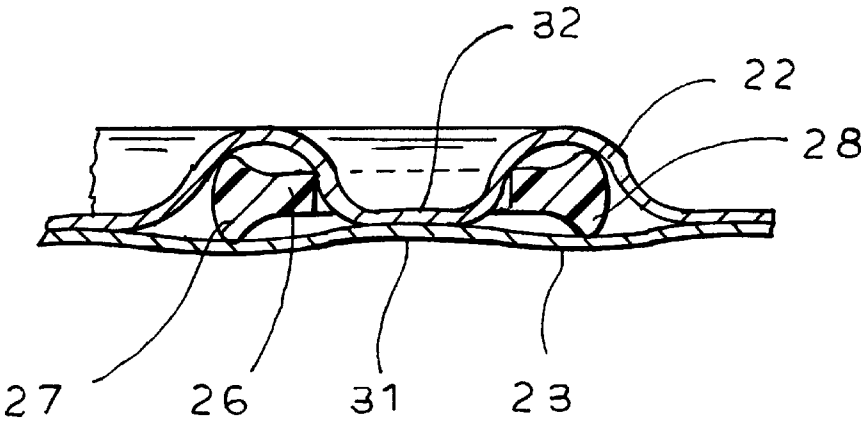
FIG. 3 is a cross sectional view taken along the line III—III of FIG. 2.

In the drawing we have shown a brassiere 10 which has a pair of cups 11, 12, each of which is provided with a compound underwire 13, 14 as has been shown, for example, in FIGS. 2 and 3. The compound underwire may be affixed to the brassiere by ultrasonic welding or by stitching through the fabric portion thereof. Each compound wire comprises a fabric portion represented generally at 15 and a synthetic resin wire 16 which is held in place in the fabric portion 15 by ultrasonic welding through holes thereof. The outer end 17 of the plastic wire extends upwardly above the end 18 of the wire at the midregion of the brassiere. The brassiere is provided with shoulder straps at 19 and 20 and a back strap 21.

As can be seen in greater detail form FIG. 2, the fabric portion 15 of the compound underwire 14 can be composed of a pair of fabric layers 22 and 23 which may be the same or different and which are composed of an ultrasonically weldable knit fabric, for example a polyester yarn. The body side layer 23, for example, may be a brushed tricot while the front side layer 22 need not be a brushed tricot. Either fabric may be flexible or inflexible, depending upon the properties which are desired in the compound wire.

As can be seen also from FIGS. 2 and 3, the plastic wire 16 which forms the composite underwire structure 14 with the fabric 15, can be composed of a synthetic resin and is formed along its length with holes 24 which, in the embodiments of FIGS. 2 and 3 are elongated along the axis 25 of the wire 16. These oval holes are formed in a web 26 of the underwire which is a thin portion between thickened ribs 17 and 28 which can merge together at the rounded extremities 29 and 30 of the wire. The fabric layers 22 and 23 are pressed together at 31 through the holes 24 by the horn and anvil of the ultrasonic welding head to provide an ultrasonic weld 32 anchoring the wire 16 to the fabric. In addition, ultrasonic weld points may be provided at 33 all around the perimeter of the wire (FIG. 2) and at 34 around the perimeter of the fabric 15.

As will also be apparent from FIG. 2, the fabric 15 can extend along the wire 16, e.g. over a limited region 35 but can widen out therefrom in a region 36 in which a pad, reinforcement fabric or gel body is provided at 37 depending upon the effect required in supporting the cup. The compound wire of FIGS. 2 and 3 may be stitched and ultrasonically welded to the fabric of the brassiere along the perimeter of the fabric and at additional weld seams as may be desired. The fabrics 22 and 23 may form the outer and body contact fabrics if desired or may be simply attached to a fabric of the cup forming the body contact portion or exterior of the cup as desired.

Figure 4:
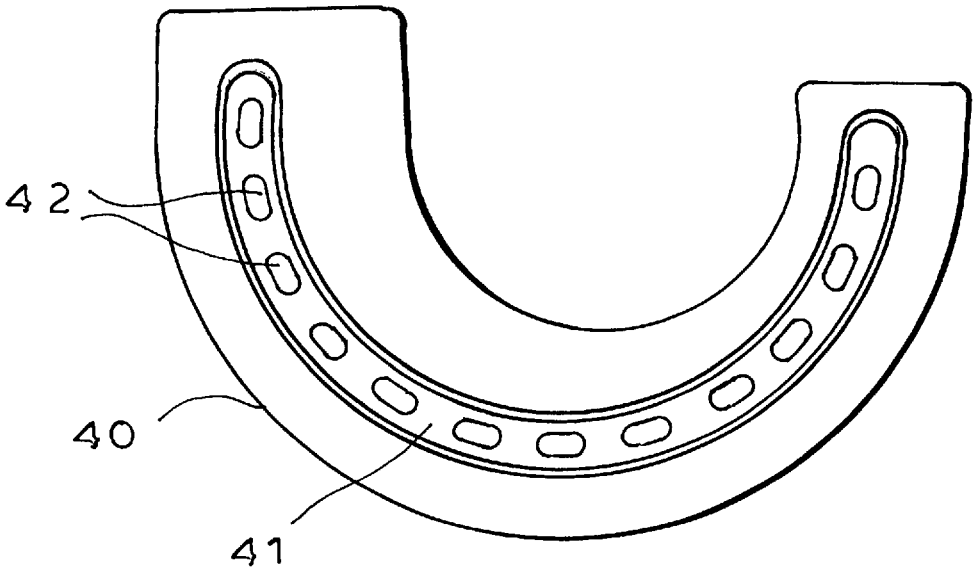
FIG. 4 is an illustration of another compound wire according to the invention.
Figure 5:
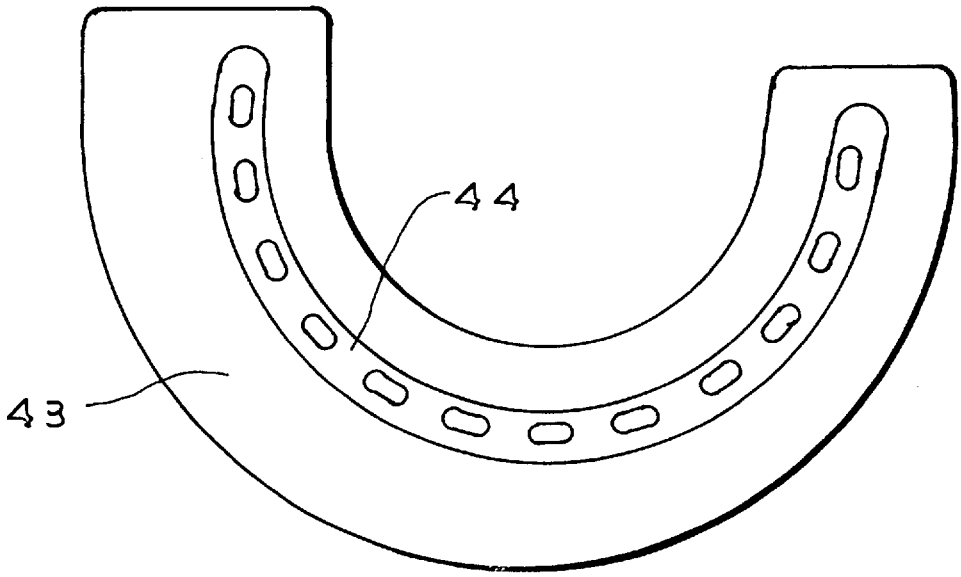
FIGS. 5, 6 and 7 are elevational views of further compound wires.
Figure 6:
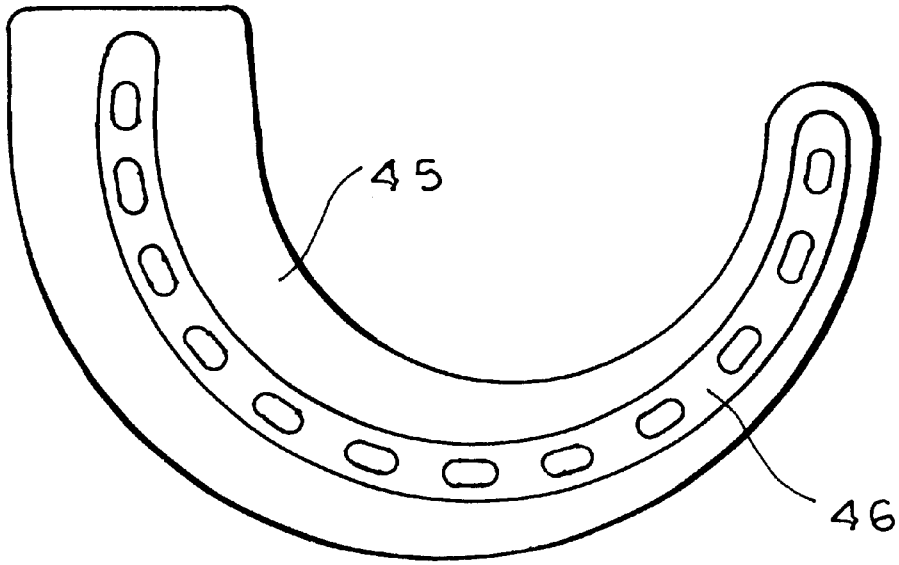
Figure 7:
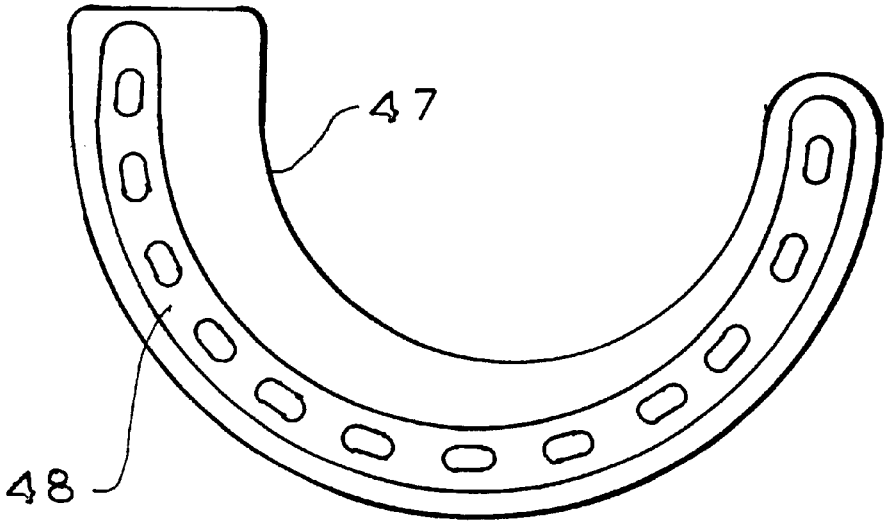
Figure 9:
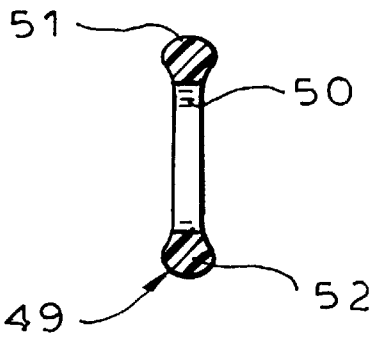
FIG. 9 is a cross sectional view taken along the line IX—IX of FIG. 8.

In FIG. 4, the fabric portion 46 extends to a greater extent on the inner side of the wire 41 than along the outer side. The wire 41 is here provided with elongated openings 42 which can be of elliptical configuration. A greater portion of the fabric 43 lies along the outer edge of the wire 44 in the embodiment shown in FIG. 2. In FIG. 6, the fabric 45 at one end of the wire 46 is disposed equally along the inner and outer side whereas in the embodiment of FIG. 7, a greater width of the fabric 47 lies along the inner edge of the wire 48.

In each case, the wire is sandwiched between two layers of fabric and these layers may be separate fabric layers or connected layers which have been folded around the wire.

Figure 11:
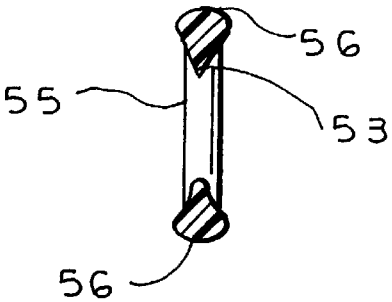
FIG. 11 is a cross sectional view along the line XI—XI of FIG. 10.
Figure 8:
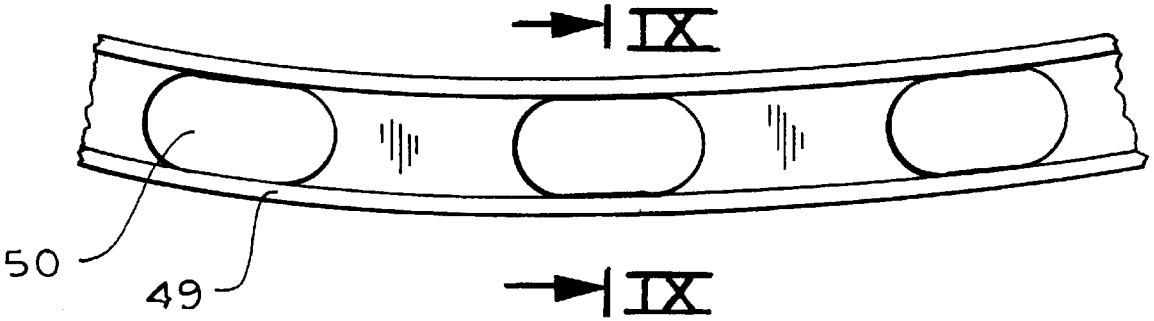
FIG. 8 is a fragmentary elevational view of the plastic wire which can be used in the compound assembly of the invention.
Figure 10:
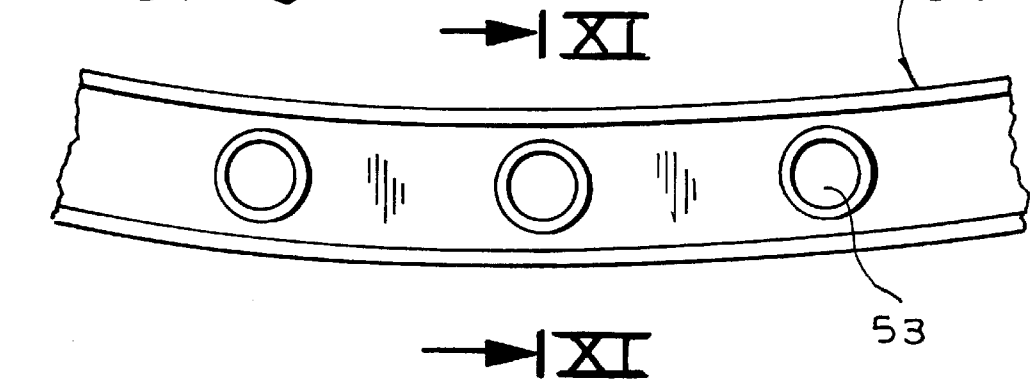
FIG. 10 is a view of another plastic wire.
Figure 13:
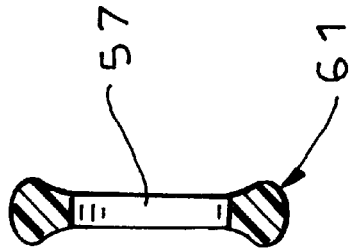
FIG. 13 is a cross sectional view taken along the line XIII—XIII of FIG. 12.
Figure 12:
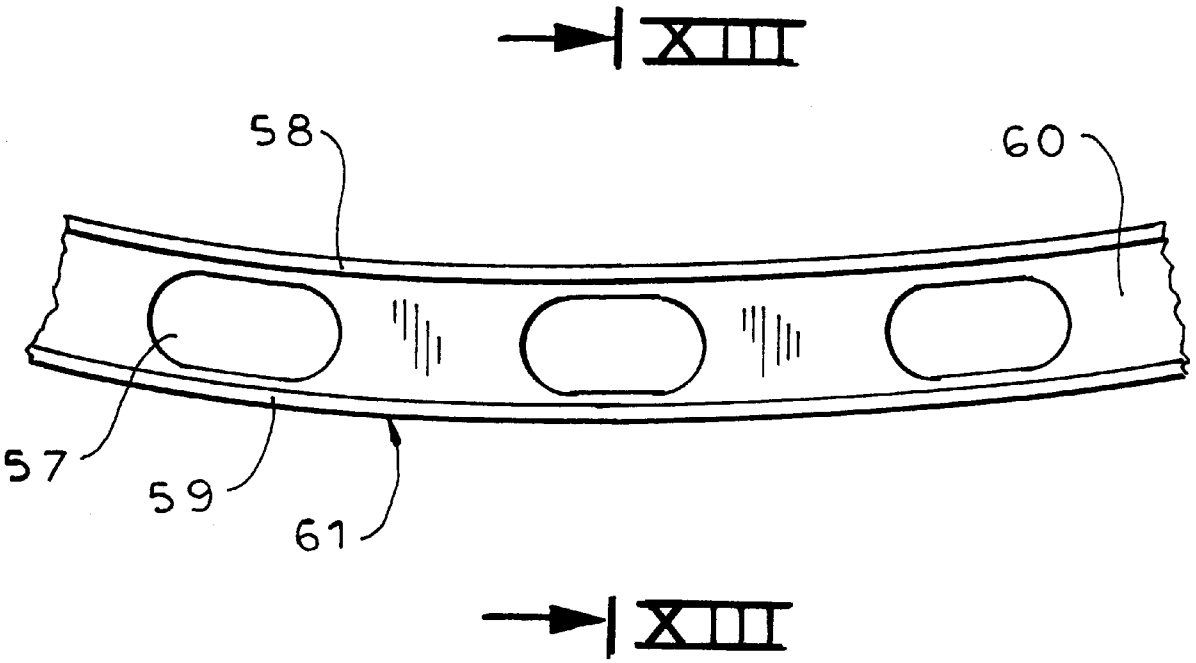
FIG. 12 is an elevational view showing still another plastic wire according to the invention.

FIGS. 8–13 show a number of wire configurations and in FIG. 8, for example, the plastic wire 49 has openings 50 which are of generally rectangular configuration, reaching substantially to the ribs 51 and 52. In the embodiment of FIGS. 10 and 11, the openings 53 in the wire 54 are circular and are provided in the web 55 inwardly of the ribs 56. Openings 57 spaced inwardly of the ribs 58 and 59 are provided in the web 60 of the wire 61 shown in FIGS. 12 and 13. In each case, the plastic wire is anchored mechanically to the fabric by the ultrasonic weld points through the holes in the wire.

Figure 15:
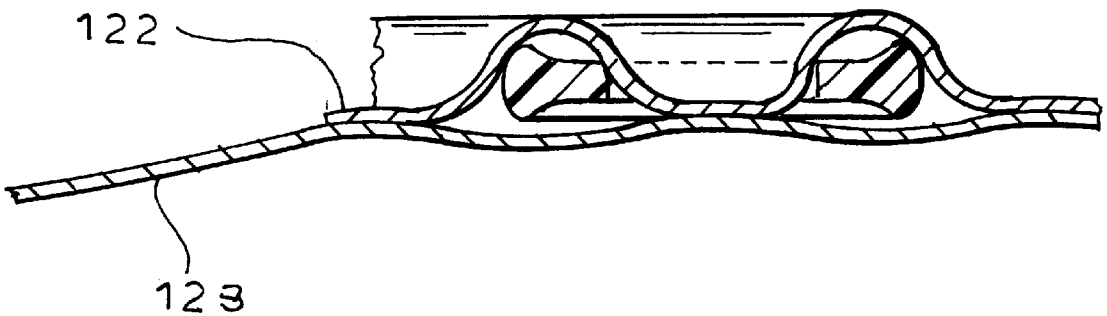
FIG. 15 is a cross sectional view taken along the line XV—XV of FIG. 14.
Figure 14:
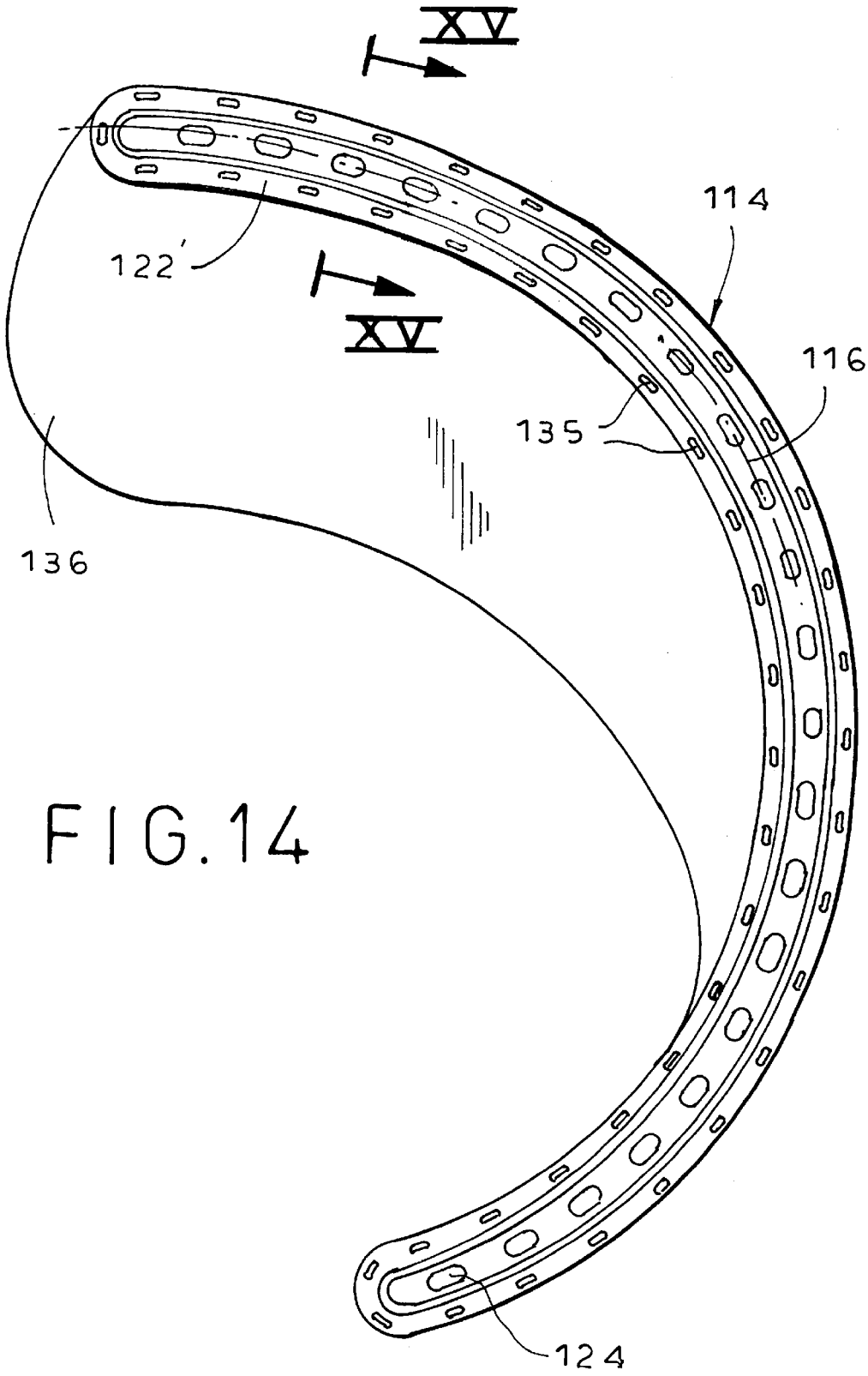
FIG. 14 is a view similar to FIG. 13 in which the flap has a single layer.

FIGS. 14 and 15 show an embodiment of the compound wire which has the flap embodiment of the compound wire 114 which has the overall configuration of that of FIG. 2, except that the fabric layer 123 which forms the flap 136 is not overlain by a corresponding portion of the upper layer 122 which terminates at an edge 122' lying along the wire 116 and is secured to the fabric 123 by a row 133 of ultrasonic weld points extending along the inner edge of the wire.

The weld points shown at 34 in FIG. 2 are unnecessary. If padding is applied here, it is applied to the single layer flap 136 and is not provided between the layers. In this embodiment, as in the embodiments previously described, the two layers 122 and 123 are also bonded together through the holes 124 in the wire.

Figure 16:
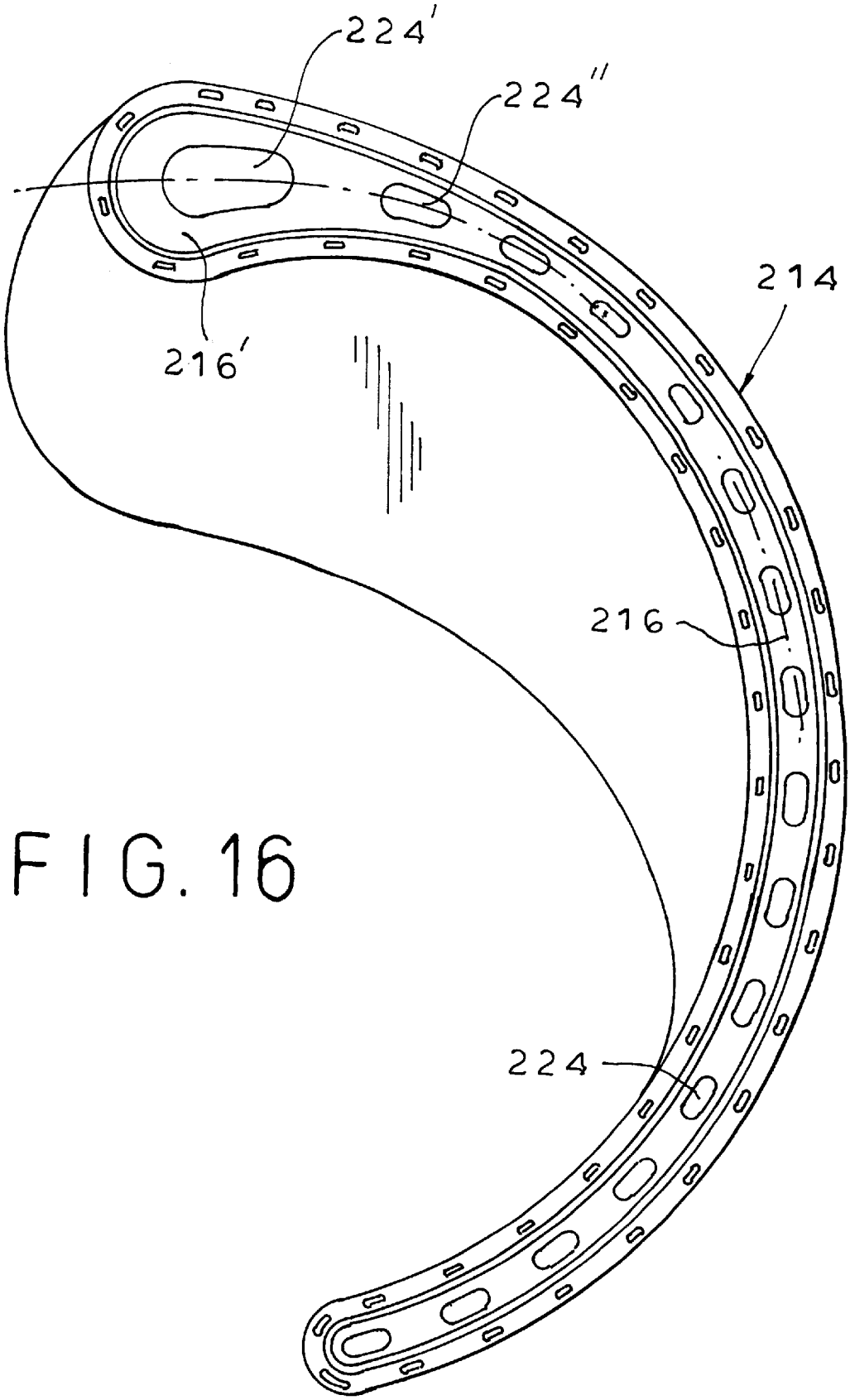
FIG. 16 is a view similar to FIG. 14 but showing the use of a wire having a spoon end.
Figure 17:
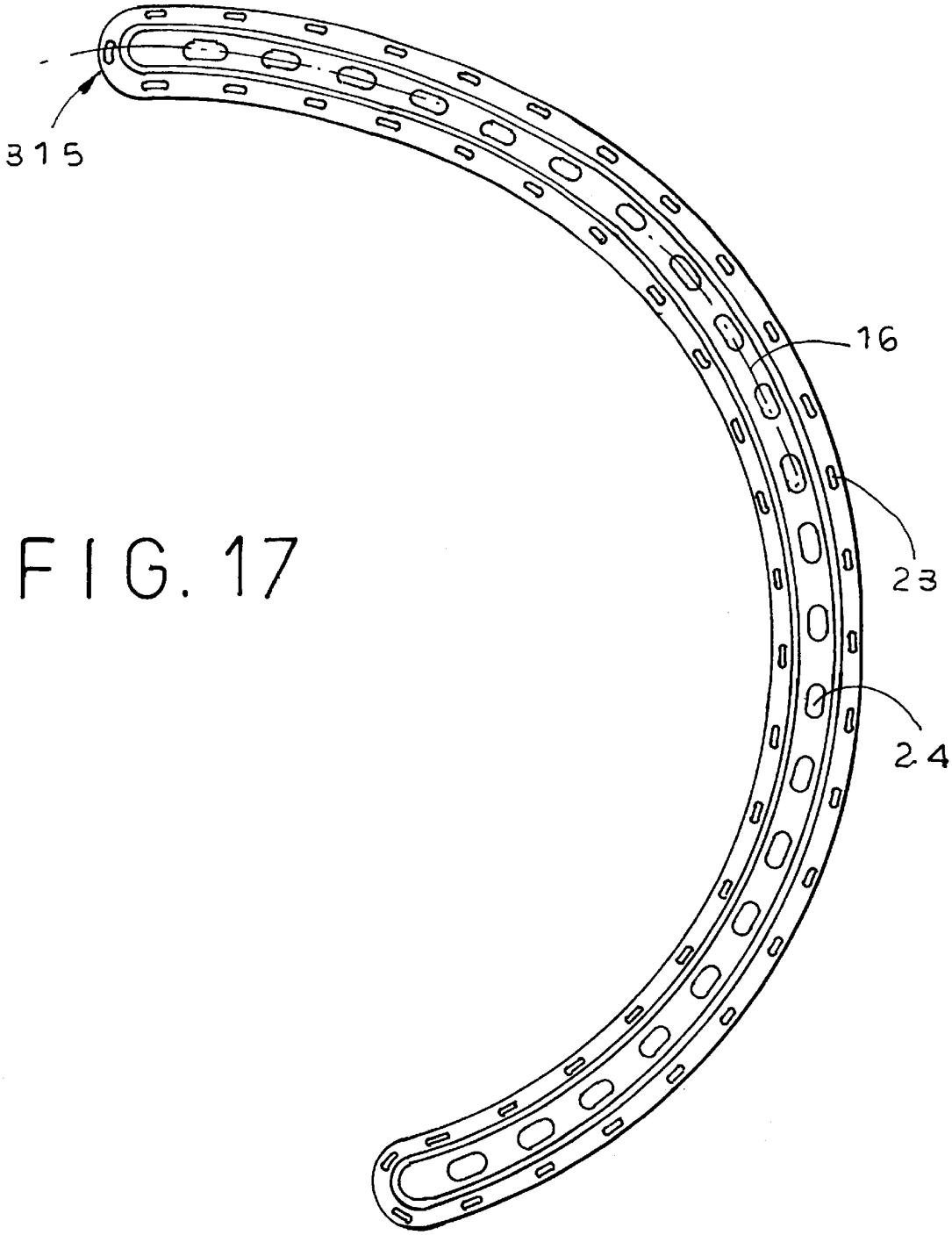
FIG. 17 is a view of the compound wire without any flap.

The compound wire 214 of FIG. 16 is generally similar to that of FIG. 14 except that the wire 216, in addition to having elongated holes 224 through which the fabric layers are welded, also has at least one end, usually the end on the outer side of the brassiere cup and remote from the midsection of the brassiere with a spoon 216' and, if desired, larger openings 224' and 224" through which the two fabric layers are welded together.

Figure 18:
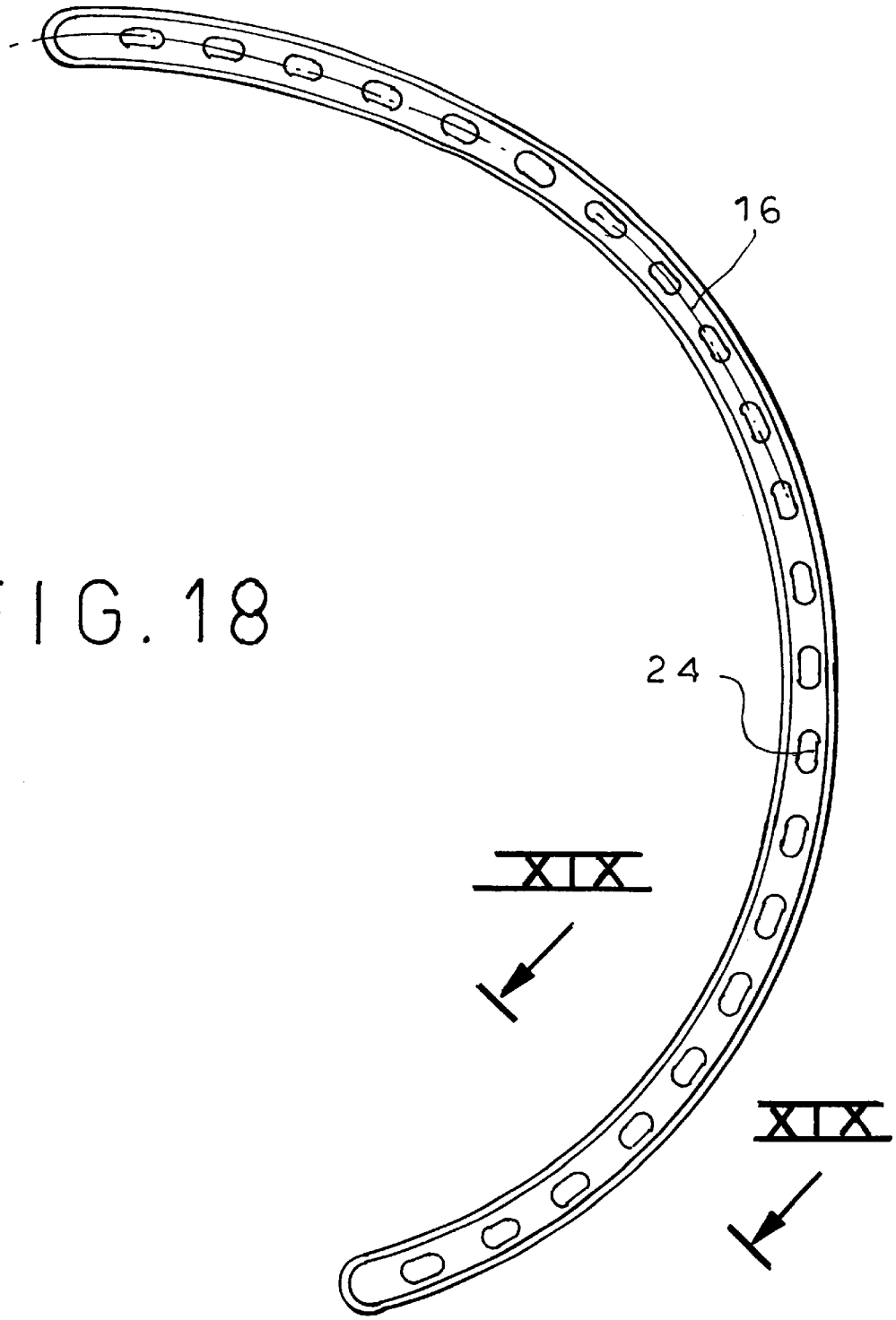
FIG. 18 is an elevational view of the wire used in the embodiments of FIGS. 2, 14, 16 and 17.
Figure 19:
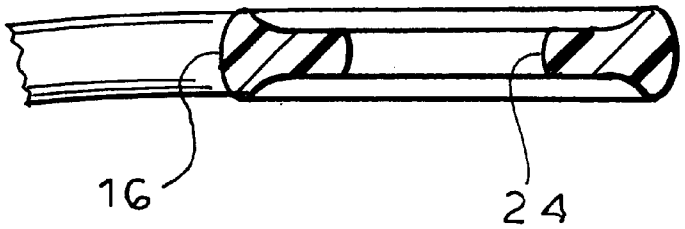
FIG. 19 is a cross sectional view taken along the line XIX—XIX of FIG. 18.

The wire 16 has been shown in full length in FIG. 18 and in enlarged form in the cross section of FIG. 19. The openings 24 are likewise visible here and the wire seem to be of uniform cross section over its length and to be provided with equally spaced-apart holes.

That wire can be incorporated between two layers of fabric whose inner and outer edges are parallel to the inner and outer sides of the wire 16 so that the fabric portion 315 conforms closely in shape to that of the wire and is secured thereto not only by the ultrasonic welds within the openings 24 but also at the weld points 33 along the inner and outer edges of the fabric.

Figure 20:
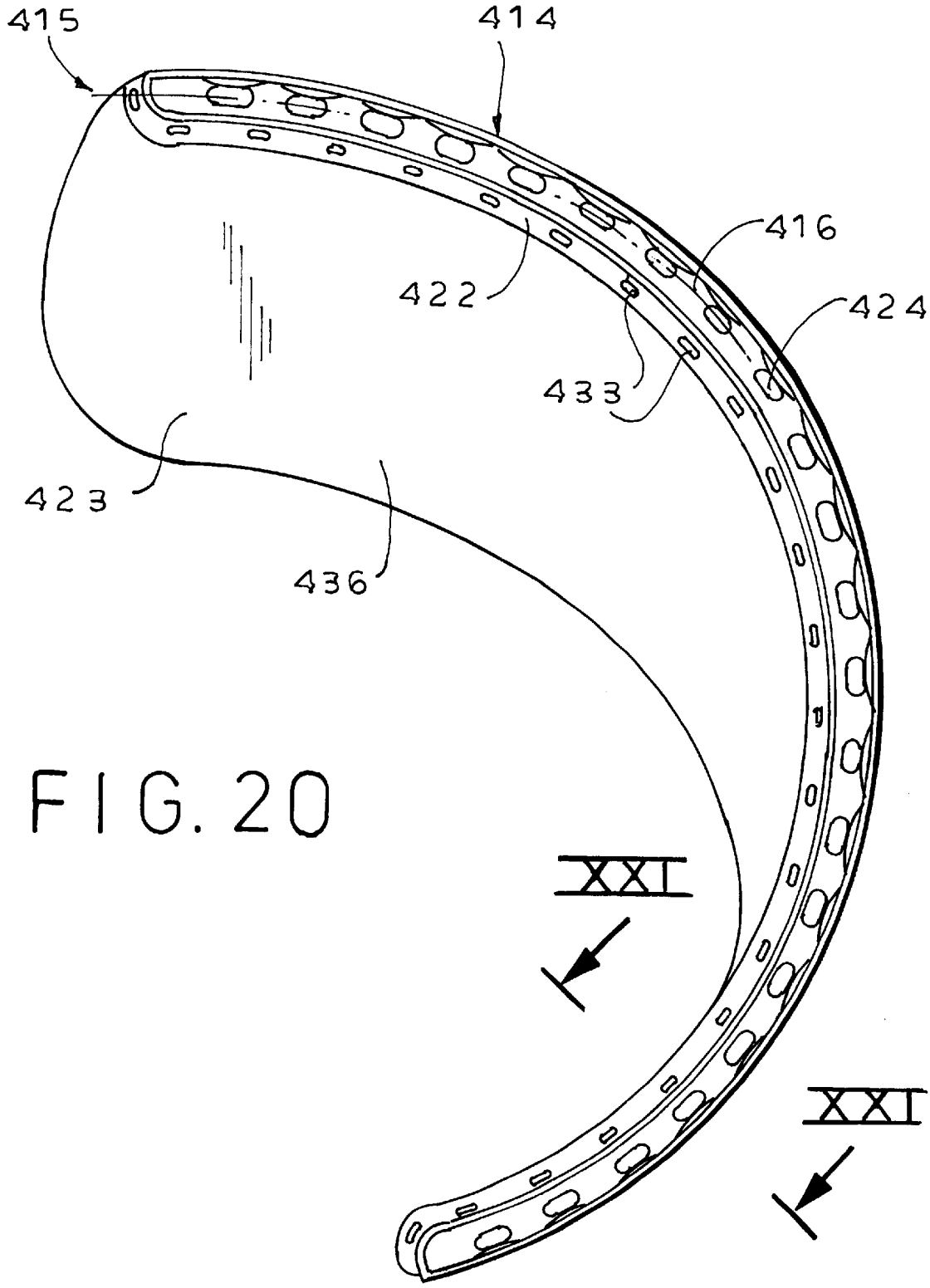
FIG. 20 is a view similar to FIG. 14 utilizing a zip wire, i.e. a wire which can be inserted and removed from a male part which can be attached to the fabric of the brassiere.

The wire shown at 414 in FIG. 20 comprises the plastic wire member 416 with its holes 424 and a fabric structure 415 which comprises a layer 423 forming a flap 431 and a layer 422 terminating along the inner edge of the wire 416 and secured to the fabric 423 by a row of ultrasonic welds 433. An outer row of welds is here omitted so that the outer edge 428 which is relatively hard, can be engaged in a groove 428' of a female part 428" which, upon being attached to the cup, can have the wire 416 readily zipped in or out. The female part 428" can be extruded onto a wheel and can be cut and attached to the brassiere as may be desired.

Figure 21:
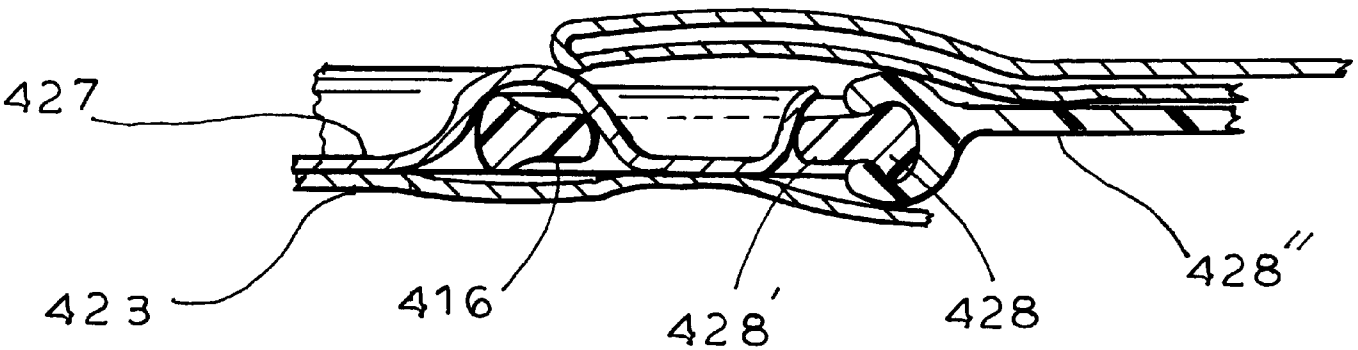
FIG. 21 is a cross sectional view taken along the line XXI—XXI of FIG. 20.

Utilizing the principles of FIGS. 20 and 21, it can be seen that the compound underwire 500 can be incorporated in a cup 501 or 502 which can be zipped in or out of the soft female member 528 which can be part of the frame 510 of the brassiere.

Figure 22:
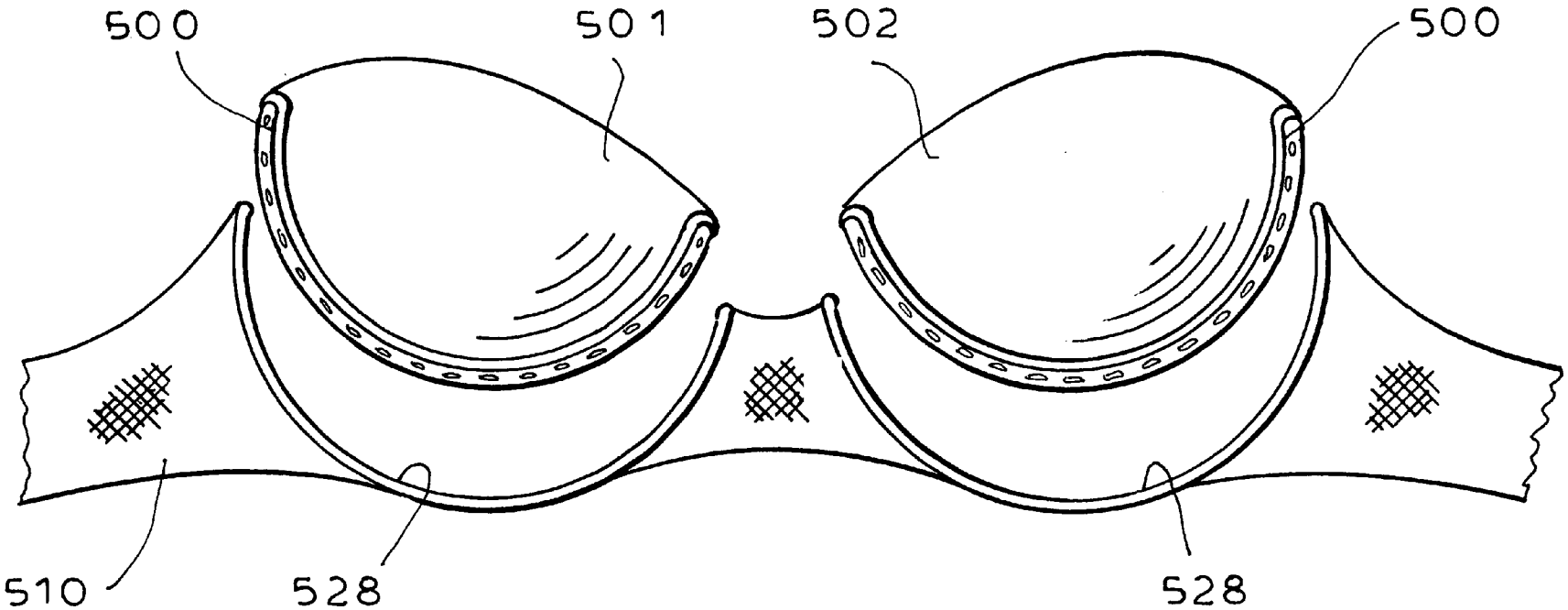
FIG. 22 is a diagrammatic elevational view showing the compound underwire as part of a brassiere cup which can be fitted into a soft frame utilizing the principals of the embodiment of FIGS. 20 and 21.
Figure 23:
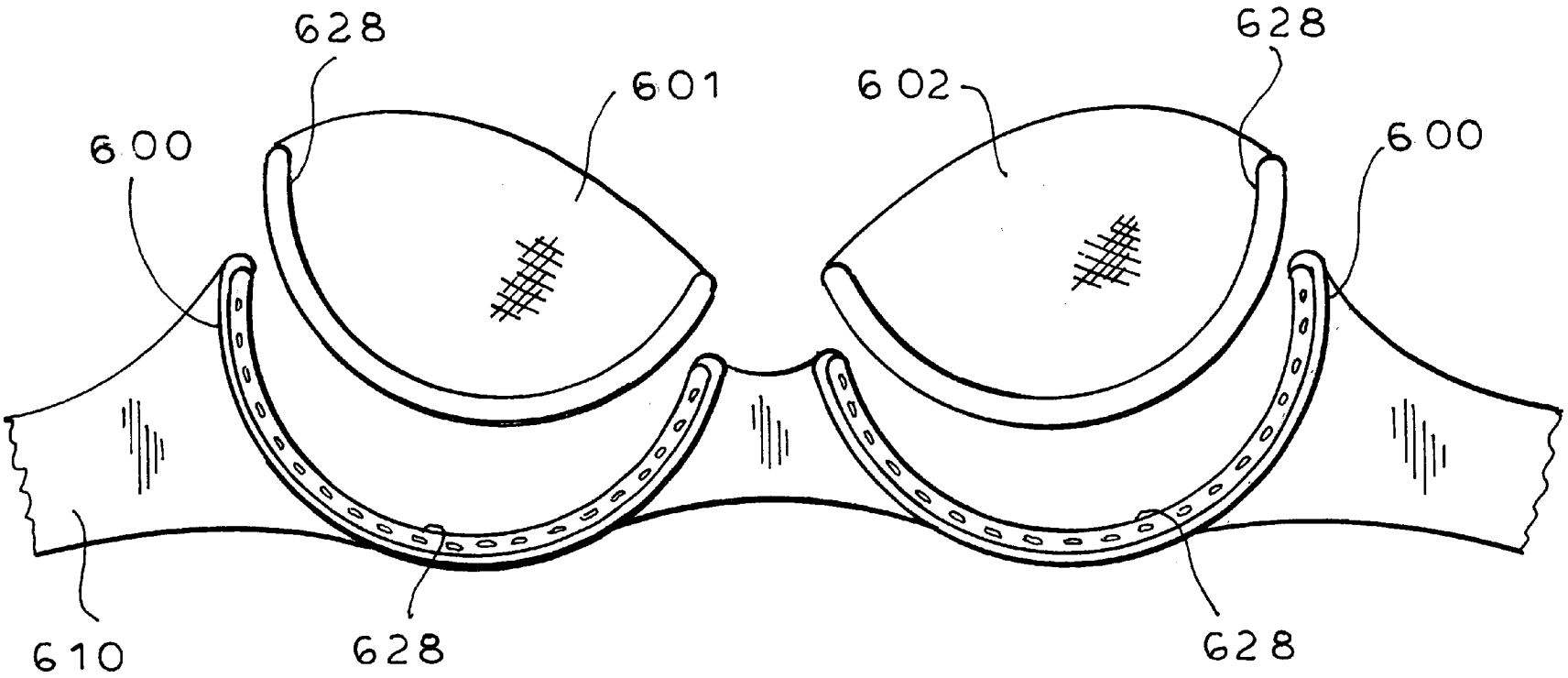
FIG. 23 is a view similar to FIG. 22 but showing the underwire as part of the frame and the cup as capable of being attached thereto utilizing the principals of the embodiment of FIGS. 20 and 21.

A reverse construction can be seen in FIG. 23 wherein soft cups 601 and 602 can be formed with grooved female members 628" analogous to the member 428" of FIG. 21 to receive the harder edge 628 of a compound wire 600 attached to the fabric of the frame 610 of the brassiere. In the embodiments of FIGS. 22 and 23, the cups can be replaced and cups of different design, fabric or contour can be constituted for one another.

Figure 24:
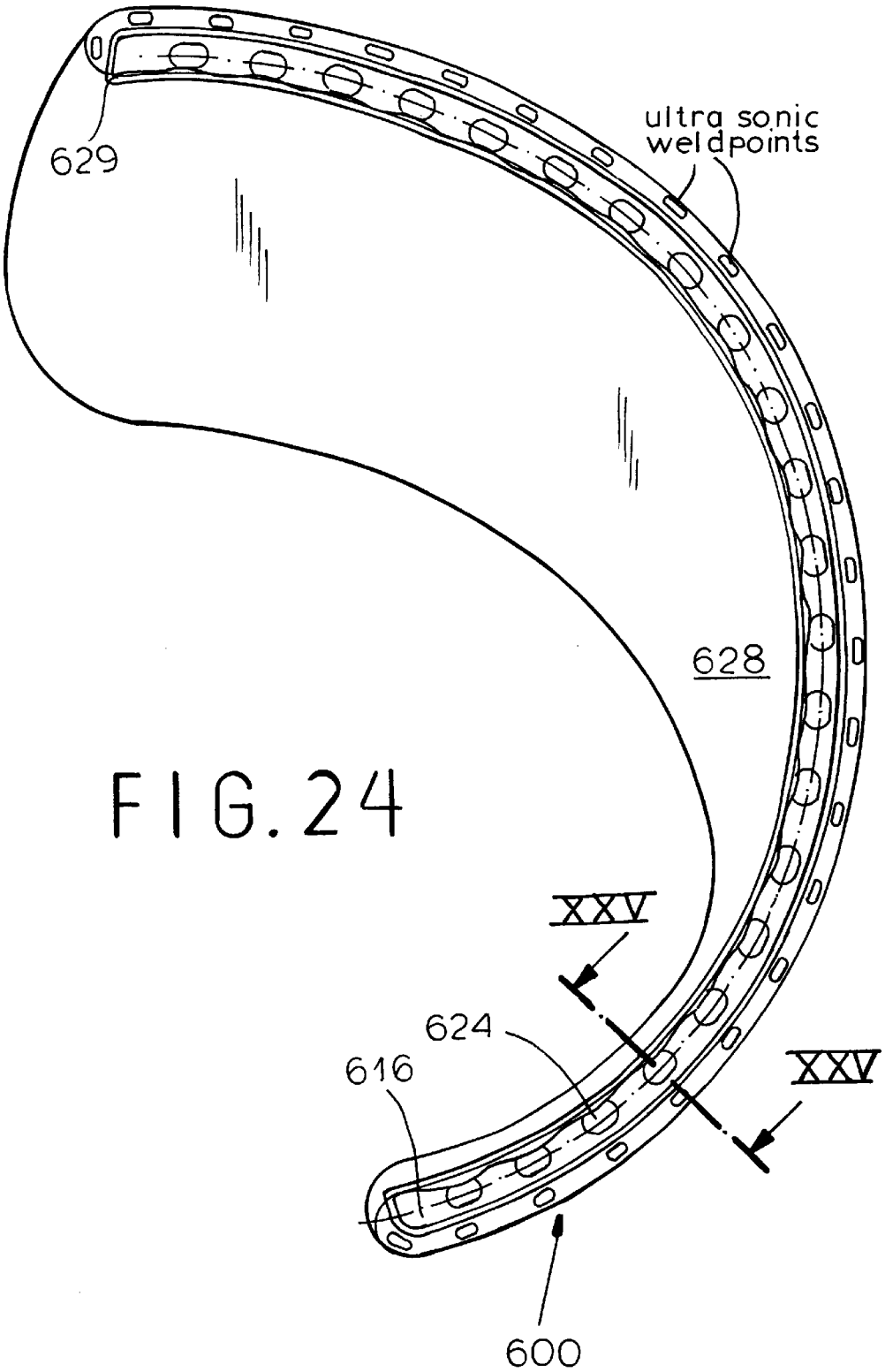
FIG. 24 is a view similar to FIG. 20 but showing the compound wire arrangement on the frame (FIG. 28)
Figure 25:
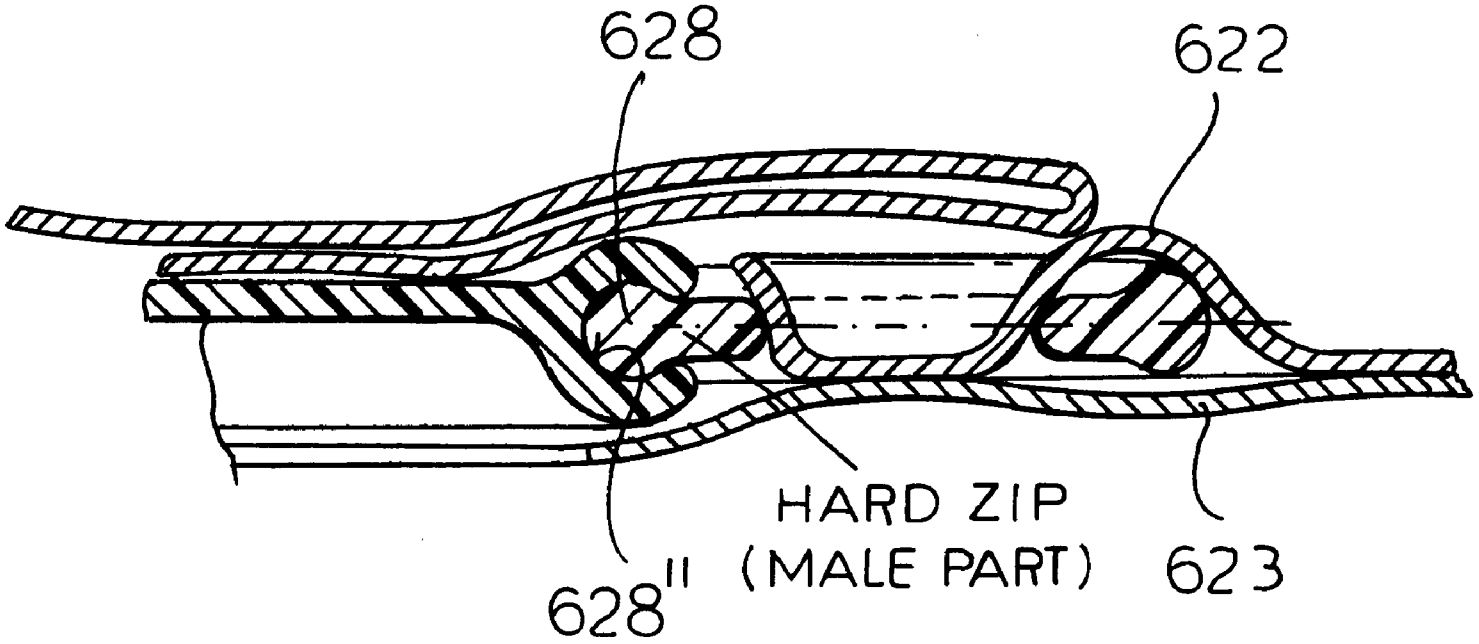
FIG. 25 is a cross sectional view taken along the line XXV—XXV of FIG. 24.

The compound wire 600, which can be welded to the frame 610 of the brassiere (compare FIGS. 23 and 24) comprises an underwire 616 which is provided with holes 624 through which the upper fabric layer 622 to the lower fabric layer 623.

When the compound wire assembly forms part of the frame, the hard edge 628 is exposed and can be engaged in the groove 628 of the female part which has a pair of flexible lips engaging the male part 628.

The cup can be thus zipped onto the frame member previously provided with the underwire. A stop 629 prevents withdrawal of the cup from engagement with the wire 616.

We claim:

1. A compound underwire assembly for a brassiere or the like comprising a plastic wire formed over a length thereof with a plurality of holes and a fabric member comprising two fabric layers ultrasonically bonded together through said holes and receiving said wire between them.

2. The assembly defined in claim 1 wherein said wire has a thin web between a pair of ribs, said holes being formed in said web.

3. The assembly defined in claim 2 wherein said holes are spaced inwardly from said web.

4. The assembly defined in claim 2 wherein said holes extend substantially to said ribs.

5. The assembly defined in claim 2 wherein said holes are of circular configuration.

6. The assembly defined in claim 2 wherein said holes are of oval configuration.

7. The assembly defined in claim 2 wherein said holes are of substantially rectangular configuration.

8. The assembly defined in claim 2, further comprising a plurality of ultrasonic weld points joining said layers together and extending along a perimeter of said assembly.

9. The assembly defined in claim 2, further comprising a plurality of ultrasonic weld points connecting said layers and extending along said wire.

10. The assembly defined in claim 2 wherein said layers receive a pad between them along an inner side of said wire.

11. The assembly defined in claim 2 wherein said fabric member has a perimeter parallel to said wire along one end portion thereof.

12. The assembly defined in claim 11 wherein said member projects away from wire along a length of said wire beyond said one end portion.

13. The assembly defined in claim 12 wherein said fabric member projects away from said wire inwardly.

14. The assembly defined in claim 1 wherein one of said layers has a brushed finish along a surface thereof adapted to face a body of the wearer.

15. The assembly defined in claim 1 wherein at least one of said layers is flexible.

16. The assembly defined in claim 1 wherein at least one of said layers is substantially inflexible.

17. The compound underwire assembly defined in claim 1 wherein said fabric layers are coextensive.

18. The compound underwire assembly defined in claim 1 wherein one of said fabric layers terminates along an edge of said plastic wire and the other of said fabric layers extends beyond said one of said layers to form a flap over at least part of the length of said assembly.

19. The compound underwire assembly defined in claim 1 wherein said plastic wire is formed at one end with a spoon.

20. The compound underwire assembly defined in claim 1, further comprising a soft female member formed with a groove into which an edge of said plastic wire can be zipped in and out.

21. A brassiere comprising a pair of fabric cups joined together at a midsection of the brassiere, each of said cups being provided with a compound underwire assembly, each of said assemblies comprising two fabric layers ultrasonically bonded together through said holes and receiving said wire between them, said wire having one end terminating at said midsection and an opposite end terminating at an outer portion of the respective cup, each wire extending beneath said cup, said assemblies being secured to the fabric of the cups.

22. The brassiere defined in claim 21 wherein each fabric member is provided on an inner side of the respective wire with a respective pad.

23. The brassiere defined in claim 21 wherein one of said layers adapted to face the body of a wearer of the brassiere is composed of a brushed fabric.

24. The brassiere defined in claim 21 wherein said holes are spaced apart uniformly over the entire length of said wire and are formed in a thin web between ribs of said wire.

25. A brassiere comprising a frame having a pair of cup receiving members joined together at a mid-section of the brassiere and a pair of cup members receivable in said cup receiving members, one of the cup and cup receiving members on each side of said midsection being formed with a groove and the other of said cup and cup receiving members having a hard edge receivable in said groove for detachably connecting the respective cup members to the respective receiving member, said hard edge being formed by an underwire.

26. The brassiere defined in claim 25 wherein said underwire forms part of a compound underwire assembly comprising two fabric layers ultrasonically bonded together through holes in said underwire and receiving said underwire between them.

* * * * *